US008008904B1

(12) United States Patent
Manan

(10) Patent No.: US 8,008,904 B1
(45) Date of Patent: Aug. 30, 2011

(54) VOLTAGE AND TEMPERATURE INVARIANT CURRENT SETTING CIRCUIT

(75) Inventor: Vikas Manan, Sunnyvale, CA (US)

(73) Assignee: Gigoptix, Inc., Palo Alto, CA (US)

( * ) Notice: Subject to any disclaimer, the term of this patent is extended or adjusted under 35 U.S.C. 154(b) by 253 days.

(21) Appl. No.: 12/184,189

(22) Filed: Jul. 31, 2008

(51) Int. Cl.
*G05F 3/16* (2006.01)
*G05F 3/20* (2006.01)
*G05F 1/10* (2006.01)
*G05F 3/02* (2006.01)

(52) U.S. Cl. ..... 323/313; 323/314; 327/539

(58) Field of Classification Search ..... 323/907, 323/312–314; 327/539
See application file for complete search history.

(56) References Cited

U.S. PATENT DOCUMENTS 6,285,244 B1 * 9/2001 Goldberg ..... 327/539
6,417,656 B1 * 7/2002 Shirai ..... 323/316
6,750,722 B2 * 6/2004 Newman et al. ..... 330/296
7,057,443 B2 * 6/2006 Nakamura ..... 327/540
7,375,504 B2 * 5/2008 Mheen et al. ..... 323/315
7,609,044 B2 * 10/2009 Huang ..... 323/313
7,609,106 B2 * 10/2009 Watanabe ..... 327/539
7,760,781 B1 7/2010 Manan
2004/0263144 A1 * 12/2004 Tseng et al. ..... 323/313
2008/0111629 A1 * 5/2008 Davenport ..... 330/285

* cited by examiner

*Primary Examiner* — Adolf Berhane
*Assistant Examiner* — Emily Pham
(74) *Attorney, Agent, or Firm* — Nixon Peabody LLP

(57) ABSTRACT

A current supply circuit provides current that is substantially invariant with voltage supply and temperature changes. The current supply circuit has an input node connectable to a voltage supply and an output node operable to provide an output current. The current supply circuit includes a current source circuit coupled to a reference voltage node and configured to provide the output current at the output node, wherein a voltage at the reference voltage node controls current output of the current source circuit. The current supply circuit also includes a reference-setting circuit coupled to the reference voltage node and operable to establish a reference current level of the current source circuit, a common-emitter circuit coupled to the input node, and an emitter-follower circuit coupled to the input node, the emitter-follower circuit having an input coupled to an output of the common-emitter circuit and an output coupled to the reference voltage node.

16 Claims, 3 Drawing Sheets

VOLTAGE AND TEMPERATURE INVARIANT CURRENT SETTING CIRCUIT

BACKGROUND

1. Technical Field

The present disclosure relates to current setting circuits such as current minors, and more particularly, to voltage and temperature invariant current setting circuits such as those used to control the gain in HBT (heterojunction bipolar transistor)-based designs.

2. Background

Current mirrors are used to accurately set currents in circuits. In multi-stage amplifier circuits that are HBT (heterojunction bipolar transistor)—based designs such as that shown in FIG. 1, the currents from the current mirrors are used to set the gain in the various stages and the overall circuit. In order to accurately control the gain, and therefore the output amplitude, especially in limiting amplifiers, the current should be set accurately and should not vary with bias or temperature (within the design specification of bias variation (typically +/−5%) and temperature variation (about −5° C. to about 85° C.)). If the current is not stable with temperature and bias, the output amplitude will undesirably vary with these parameters.

OVERVIEW

As described herein, a current supply circuit having an input node connectable to a voltage supply and an output node operable to provide an output current includes a current source circuit coupled to a reference voltage node and configured to provide the output current at the output node, wherein a voltage at the reference voltage node controls current output of the current source circuit. The current supply circuit also includes a reference-setting circuit coupled to the reference voltage node and operable to establish a reference current level of the current source circuit, a common-emitter circuit coupled to the input node, and an emitter-follower circuit coupled to the input node, the emitter-follower circuit having an input coupled to an output of the common-emitter circuit and an output coupled to the reference voltage node.

Also described herein is a current supply circuit having an input node connectable to a voltage supply and an output node operable to provide an output current, the current supply circuit including means coupled to a reference voltage node for providing the output current at the output node, wherein a voltage at the reference voltage node controls current output of the means for providing the output current, means coupled to the reference voltage node for setting a reference current level of the means for providing the output current, an amplifying means coupled to the input node, and means for buffering voltage from the input node and having an input coupled to an output of the amplifying means and an output coupled to the reference voltage node.

BRIEF DESCRIPTION OF THE SEVERAL VIEWS OF THE DRAWINGS

The accompanying drawings, which are incorporated into and constitute a part of this specification, illustrate one or more examples of embodiments and, together with the description of example embodiments, serve to explain the principles and implementations of the embodiments.

DESCRIPTION OF EXAMPLE EMBODIMENTS

Figure 1:
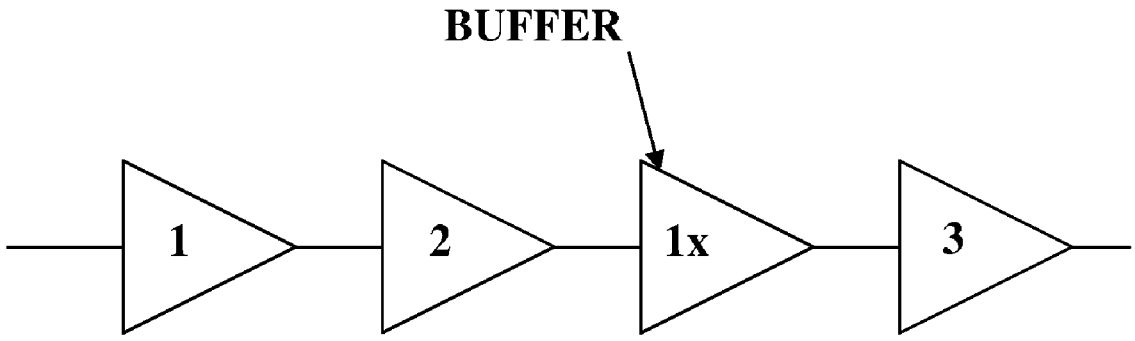
FIG. 1 is schematic diagram of a multi-stage amplifier circuit in which current source circuits can be used.

The description herein is provided in the context of a current control mechanism for low voltage applications. Those of ordinary skill in the art will realize that the following detailed description is illustrative only and is not intended to be in any way limiting. Other embodiments will readily suggest themselves to such skilled persons having the benefit of this disclosure. Reference will now be made in detail to implementations as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As used herein, the symbol n+ indicates an n− doped semiconductor material typically having a doping level of n− type dopants on the order of $10^{20}$ atoms per cubic centimeter or more. The symbol n− indicates an n−doped semiconductor material (such a silicon (Si), germanium (Ge), Gallium Arsenide (GaAs), and the like) typically having a doping level on the order of $10^{17}$ atoms per cubic centimeter for n− doped wells and on the order of $10^{15}$ atoms per cubic centimeter for n− substrate material. The symbol p+ indicates a p− doped semiconductor material typically having a doping level of p-type dopants on the order of $10^{20}$ atoms per cubic centimeter or more. The symbol p− indicates a p− doped semiconductor material typically having a doping level on the order of $10^{17}$ atoms per cubic centimeter for p− doped wells and on the order of $10^{15}$ atoms per cubic centimeter for p− substrate material. Those of ordinary skill in the art will now realize that a range of doping concentrations around those described above will also work. Furthermore, the devices described herein may be formed on a conventional semiconductor substrate or they may as easily be formed as a thin film transistor (TFT) above the substrate, or in silicon on an insulator (SOI) such as glass (SOG), sapphire (SOS), or other substrates as known to those of ordinary skill in the art. Essentially, any process capable of forming pFETs and nFETs will work. Doped regions may be diffusions or they may be implanted. When it is said that something is doped at approximately the same level as something else, the doping levels are within a factor of ten of each other, e.g., $10^{16}$ is within a factor of ten of $10^{15}$ and $10^{17}$.

Figure 2:
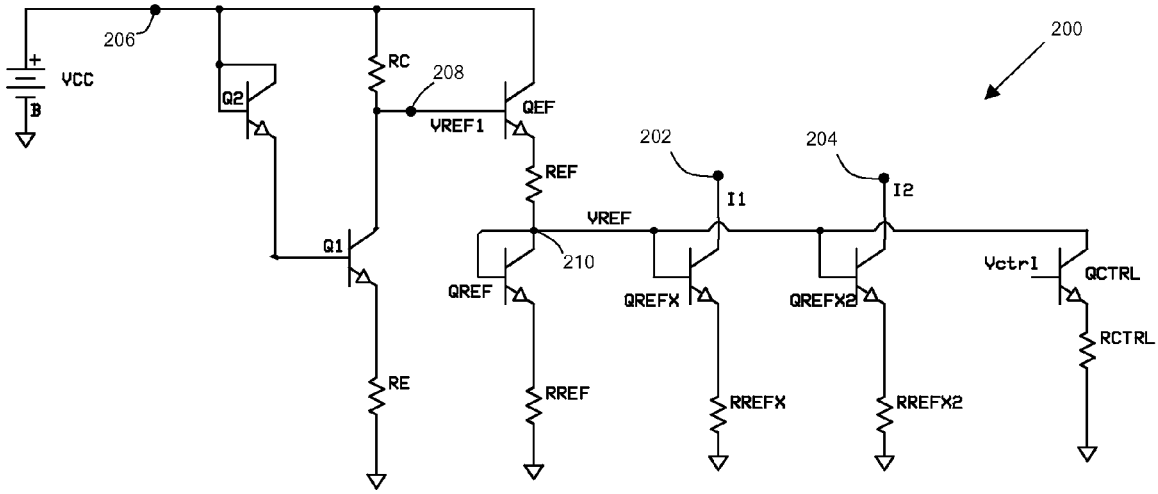
FIG. 2 is a schematic diagram of a circuit for sourcing currents that can tolerate voltage changes in the voltage source.

FIG. 2 is a schematic diagram of a circuit 200 for sourcing currents $I_1$, $I_2$ that can tolerate voltage changes in the voltage source. That is, in circuit 200, current sources $I_1$, $I_2$ at outputs 202, 204 are substantially voltage invariant, effectively maintaining their current level despite changes in voltage at voltage source VCC applied at circuit input 206. While only two current source outputs at $I_1$, $I_2$ are provided in this example, it will appreciated that the circuit 200 is not so limited and can instead be adapted to provide a greater (or smaller) number of current sources if desired.

Figure 3:
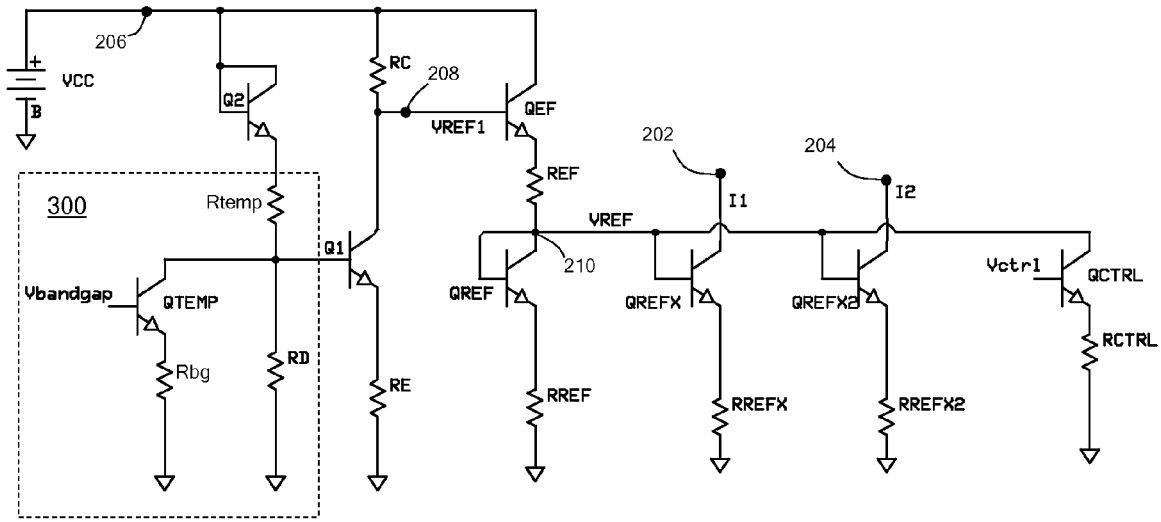
FIG. 3 is schematic diagram of a circuit such as that of FIG. 2, with an optional temperature compensation section.

Circuit 200 includes a linear common-emitter circuit comprising resistors RC (collector) and RE (emitter) and transistor Q1 coupled therebetween. The linear common-emitter circuit operates as a means for amplifying voltage. In the example embodiment of FIG. 2 (and FIG. 3), transistor Q1 is an HBT (heterojunction bipolar transistor), and the common-emitter circuit is shown using an NPN topology, with the understanding that this not intended to be limiting and a PNP topology is also contemplated. Resistors RC and RE are used for bias voltage compensation. Q1 controls the current through RC and RE and the voltage at VREF1. Q2, also an HBT, operates to step down the voltage from supply voltage VCC, and in the example embodiments of FIGS. 2 and 3, is configured as a diode, although this is not by way of limitation and an actual diode can be used. Further, depending on the voltage supply level, one or more such step-down devices my be employed.

As mentioned above, RC and RE provide bias voltage compensation. Specifically, if voltage source VCC varies by a voltage amount ΔVCC, the current through transistor Q1 changes by ΔVCC/RE. The change in current through transistor Q1 is expressed as ΔIQ1 and is substantially equivalent to ΔVCC/RE. The voltage VREF1 at the output 208 of the linear common-emitter circuit can be maintained constant if ΔIQ1×RC is ΔVCC, or, in other words, if $$\Delta VCC/RE \times RC = \Delta VCC, \text{ or}$$

$$RC = RE$$

with the assumption that the beta β (common-emitter current gain) of transistor Q1 is high, so that collector current is substantially the same as emitter current. Of course, while expressed in terms of two resistors RC and RE having equal values, each of these passive devices may itself comprise for example multiple resistors or other means for providing electrical resistance, or, more generally, impedance.

VREF1 at node 208 operates as the input to an emitter-follower circuit comprising transistor QEF and resistor REF, the output of which is coupled to VREF at node 210. QEF, in this example embodiment, is an HBT (heterojunction bipolar transistor). A constant VREF1 helps to maintain a constant voltage at reference voltage node VREF in spite of changes in VCC. The constant VREF keeps the reference current through QREF constant. The device QREF operates as the means for setting the reference current for the current sources, and is not limited to a transistor configured in the manner shown, but can be a diode instead. In the specific example embodiment depicted in FIG. 2 (and FIG. 3), QREF is an HBT that is configured as a diode because the Vbe (base-emitter voltage) of such an HBT is similar for both QREF and QREFX, QREFX2, etc., which are also for example HBTs.

The emitter-follower QEF, REF is used to minimize the loading effect on VREF1 due to the diode current of the reference QREF and base currents for QREFX,QREFX2. The resistor REF is used to adjust the reference current through the reference diode QREF. RREF operates along with QREF to set the reference current for $I_1$, $I_2$ (and any other current sources) by appropriate scaling of QREFX, QREFX2 and RREFX1, RREFX2.

It may also be desired to achieve temperature compensation so that the circuit is temperature invariant as well as voltage invariant. With reference to FIG. 3, an optional temperature compensation section is shown generally at 300. Temperature compensation section 300 includes resistors Rtemp and RD, bandgap transistor QTEMP, and resistor Rbg. A bandgap voltage Vbandgap, generated by a separate bandgap circuit (not shown) that is well-known in this type of application, is applied to the base of QTEMP (also an HBT device in this embodiment), and provides a voltage reference that is fixed over temperature and bias. It is used to compensate for changes in current due to temperature. In HBT devices, these changes arise from transistor characteristic changes, such as changes in Vbe (base-emitter voltage) and in β (common-emitter current gain). In particular, the Vbe of an HBT device drops with temperature, and, without compensation, this drop leads to an increase in current.

With section 300, the voltage change at the base of Q1 is determined by the ratio between Rtemp and RD (voltage divider circuit). RD/(RD+Rtemp) sets the percentage of ΔVCC (change in VCC) that leads to a change in the current through Q1—that is ΔIQ1. The current change through Q1 (ΔIQ1) due to ΔVCC will be $$RD/(RE+R\text{temp}) \times \Delta VCC/RE$$

In order to keep VREF1 constant, the voltage across RC should also change by ΔVCC. This then leads to the following equations:

$$\Delta IQ1 \times RC = RC \times RD/(RD+R\text{temp}) \times \Delta VCC/RE = \Delta VCC, \text{ or}$$

$$RC/RE = (RD+R\text{temp})/RD$$

In the this manner, in the circuit of FIG. 3, VREF1 is maintained substantially constant, despite variations in temperature and source voltage (VCC), thereby substantially maintaining a constant VREF. As in the case of the FIG. 2 circuit, the constant VREF keeps the reference current through QREF constant. Again the emitter-follower QEF is used to minimize the loading effect on VREF1 due to the diode current of the reference QREF and base currents for QREFX,QREFX2, the resistor REF is used to adjust the reference current through the reference diode QREF, and QREF, RREF set the reference current for $I_1$, $I_2$ (and any other current sources) by appropriate scaling of QREFX, QREFX2 and RREFX1, RREFX2.

The transistor QCTRL, also an HBT in these example embodiments, is provided for changing the value (that is, amplitude) of $I_1$ and $I_2$ by changing the voltage Vctrl. Such current amplitude control may be desired depending on the specific application.

The above are exemplary modes of carrying out the invention and are not intended to be limiting. It will be apparent to those of ordinary skill in the art that modifications thereto can be made without departure from the spirit and scope of the invention as set forth in the following claims.

What is claimed:

1. A current supply circuit having an input node connectable to a voltage supply and an output node operable to provide an output current, the current supply circuit comprising:

a current source circuit coupled to a reference voltage node and configured to provide the output current at the output node, wherein a voltage at the reference voltage node controls current output of the current source circuit;

a reference-setting circuit coupled to the reference voltage node and operable to establish a reference current level of the current source circuit;

a common-emitter circuit coupled to the input node; and an emitter-follower circuit coupled to the input node, the emitter-follower circuit having an input coupled to an output of the common-emitter circuit and an output coupled to the reference voltage node, the emitter-follower circuit operable to provide at the reference voltage node a voltage that is based on voltage of the voltage supply.

2. The current supply circuit of claim 1, further comprising one or more additional current source circuits coupled to the reference voltage node.

3. The current supply circuit of claim 2, wherein the one or more additional current source circuits each comprises an HBT (heterojunction bipolar transistor) having a base coupled to the reference voltage node.

4. The current supply circuit of claim 1, wherein the current source circuit comprises an HBT (heterojunction bipolar transistor) having a base coupled to the reference voltage node.

5. The current supply circuit of claim 1, further comprising at least one step-down device coupled between the input node and to a base of a transistor of the common-emitter circuit.

6. The current supply circuit of claim 1, wherein the step-down device is a transistor configured as a diode.

7. The current supply circuit of claim 1, wherein the reference-setting circuit includes a transistor coupled to the reference voltage node.

8. The current supply circuit of claim 7, wherein the transistor coupled to the voltage reference node is configured as a diode.

9. The current supply circuit of claim 1, further comprising a temperature compensation section coupled to the common-emitter circuit, the temperature compensation section having an input configured to receive a bandgap reference voltage.

10. The current supply circuit of claim 9, wherein the temperature compensation section comprises a temperature resistor, a diode resistor, a bandgap resistor, and a transistor having a base to which the bandgap reference voltage is applied and having a collector node and an emitter node, wherein one of the nodes is coupled to the bandgap resistor and other of the nodes is coupled to a base of a transistor of the common-emitter circuit.

11. The current supply circuit of claim 1, wherein the common-emitter circuit includes one or more collector resistors and one or more emitter resistors of substantially equal value to the one or more collector resistors.

12. The current supply circuit of claim 1, further comprising a current amplitude control device configured to control output current amplitude based on an input voltage signal.

13. A current supply circuit having an input node connectable to a voltage supply and an output node operable to provide an output current, the current supply circuit comprising:

means coupled to a reference voltage node for providing the output current at the output node, wherein a voltage at the reference voltage node controls current output of the means for providing the output current;

means coupled to the reference voltage node for setting a reference current level of the means for providing the output current;

an amplifying means coupled to the input node; and an emitter-follower having an input coupled to an output of the amplifying means and an output coupled to the reference voltage node, the emitter-follower circuit operable to provide at the reference voltage node a voltage that is based on voltage of the voltage supply.

14. The current supply circuit of claim 13, further comprising one or more additional means for providing output current.

15. The current supply circuit of claim 13, further comprising at least one means for stepping down voltage from the input node to an input of the amplifying means.

16. The current supply circuit of claim 13, further comprising temperature compensation means.

* * * * *